US009861249B2

(12) United States Patent
Kim et al.

(10) Patent No.: US 9,861,249 B2
(45) Date of Patent: Jan. 9, 2018

(54) DISHWASHER AND A METHOD FOR CONTROLLING THE SAME

(71) Applicant: LG ELECTRONICS INC., Seoul (KR)

(72) Inventors: Seongho Kim, Seoul (KR); Youmin Lee, Seoul (KR); Jongmin Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 480 days.

(21) Appl. No.: 14/192,160

(22) Filed: Feb. 27, 2014

(65) Prior Publication Data

US 2014/0283880 A1 Sep. 25, 2014

(30) Foreign Application Priority Data

Feb. 28, 2013 (KR) ..... 10-2013-0022322

(51) Int. Cl.

| | |
|---|---|
| ***A47L 15/00*** | (2006.01) |
| ***A47L 15/14*** | (2006.01) |
| *A47L 15/42* | (2006.01) |

(52) U.S. Cl.

CPC ..... *A47L 15/0047* (2013.01); *A47L 15/4291* (2013.01); *A47L 15/4221* (2013.01); *A47L 2401/07* (2013.01); *A47L 2401/08* (2013.01); *A47L 2401/20* (2013.01); *A47L 2501/03* (2013.01); *A47L 2501/05* (2013.01)

(58) Field of Classification Search

CPC ..... A47L 15/0047; A47L 15/4221; A47L 15/4291; A47L 2401/08; A47L 2401/20; A47L 2501/03; A47L 2501/05; A47L 2401/07

See application file for complete search history.

(56) References Cited

U.S. PATENT DOCUMENTS

| | | | | |
|---|---|---|---|---|
| 8,157,923 | B1 * | 4/2012 | Mohrbacher, Jr. .. | A47L 15/0031 134/10 |
| 2007/0151579 | A1 * | 7/2007 | Hooker ..... | A47L 15/0023 134/18 |
| 2007/0163626 | A1 * | 7/2007 | Klein ..... | A47L 15/0049 134/56 D |
| 2007/0277854 | A1 * | 12/2007 | Eiermann ..... | A47L 15/4291 134/18 |

(Continued)

FOREIGN PATENT DOCUMENTS

| | | |
|---|---|---|
| CN | 101862171 A | 10/2010 |
| DE | 197 36 347 A1 | 2/1999 |

(Continued)

OTHER PUBLICATIONS

European Search Report dated Jul. 1, 2014 issued in Application No. 14157023.4.

European Office Action dated Apr. 19, 2016.

*Primary Examiner* — Alexander Markoff

(74) *Attorney, Agent, or Firm* — KED & Associates, LLP

(57) ABSTRACT

A dishwasher is provided. The dishwasher may include a tub forming a washing space, a sump collecting washing water, a tank forming a storage space outside the tub, a motor generating a dynamic force to supply the washing water collected in the sump to the tank, and a controller incrementally increasing a water level of the tank by intermittently driving the motor.

12 Claims, 8 Drawing Sheets

(56) References Cited

U.S. PATENT DOCUMENTS

| | | | | |
|---|---|---|---|---|
| 2010/0043840 | A1* | 2/2010 | Kim | A47L 15/0052 134/34 |
| 2010/0176754 | A1* | 7/2010 | Navarra | A47L 15/4225 318/8 |
| 2011/0132407 | A1* | 6/2011 | Fauth | A47L 15/0015 134/25.2 |
| 2012/0145200 | A1* | 6/2012 | Jerg | A47L 15/0015 134/25.2 |

FOREIGN PATENT DOCUMENTS

| | | | | |
|---|---|---|---|---|
| DE | 10 2009 029 185 | | 3/2011 | |
| EP | 0607628 | A1 * | 7/1994 | A47L 15/4291 |
| EP | 1243219 | A2 * | 9/2002 | A47L 15/42 |
| EP | 2 292 139 | A1 | 3/2011 | |
| EP | 2397061 | A1 * | 12/2011 | A47L 15/4291 |
| EP | 2478817 | A1 * | 7/2012 | A47L 15/0036 |
| EP | 2497404 | A1 * | 9/2012 | A47L 15/0002 |
| EP | 2524642 | A1 * | 11/2012 | A47L 15/4291 |
| WO | WO 2012/171887 | A1 | 12/2012 | |

* cited by examiner

DISHWASHER AND A METHOD FOR CONTROLLING THE SAME

CROSS-REFERENCE TO RELATED APPLICATION(S)

This application claims priority under 35 U.S.C. §119 to Korean Application No. 10-2013-0022322 filed in Korea on Feb. 28, 2013, whose entire disclosure is hereby incorporated by reference.

BACKGROUND

1. Field

This relates to a dishwasher, and more specifically, to a dishwasher that may efficiently store washing water collected in a sump.

2. Background

A dishwasher may wash dirty dishes using high-pressure washing water ejected from a washing arm. A dishwasher may include a tub forming a washing chamber and a sump mounted at a lower portion of the tub to store washing water. Washing water may be delivered to the washing arm by a pump provided in the sump, and the washing water may be ejected at high pressure through a jet nozzle formed at the washing arm and onto the surface of the dishes to remove waste from the dishes. The used washing water may be separated from the waste, collected in the sump, then discharged to the outside.

BRIEF DESCRIPTION OF THE DRAWINGS

The embodiments will be described in detail with reference to the following drawings in which like reference numerals refer to like elements wherein.

DETAILED DESCRIPTION

Figure 1:
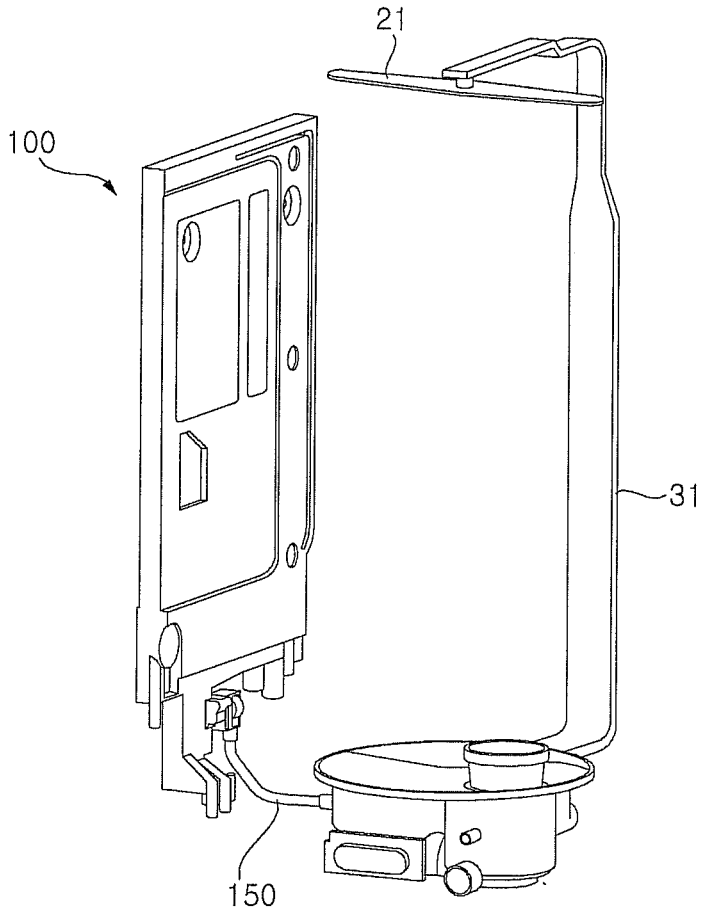
FIG. 1 is a perspective view of a tank and related components of a dishwasher, according to an embodiment as broadly described herein.
Figure 2:
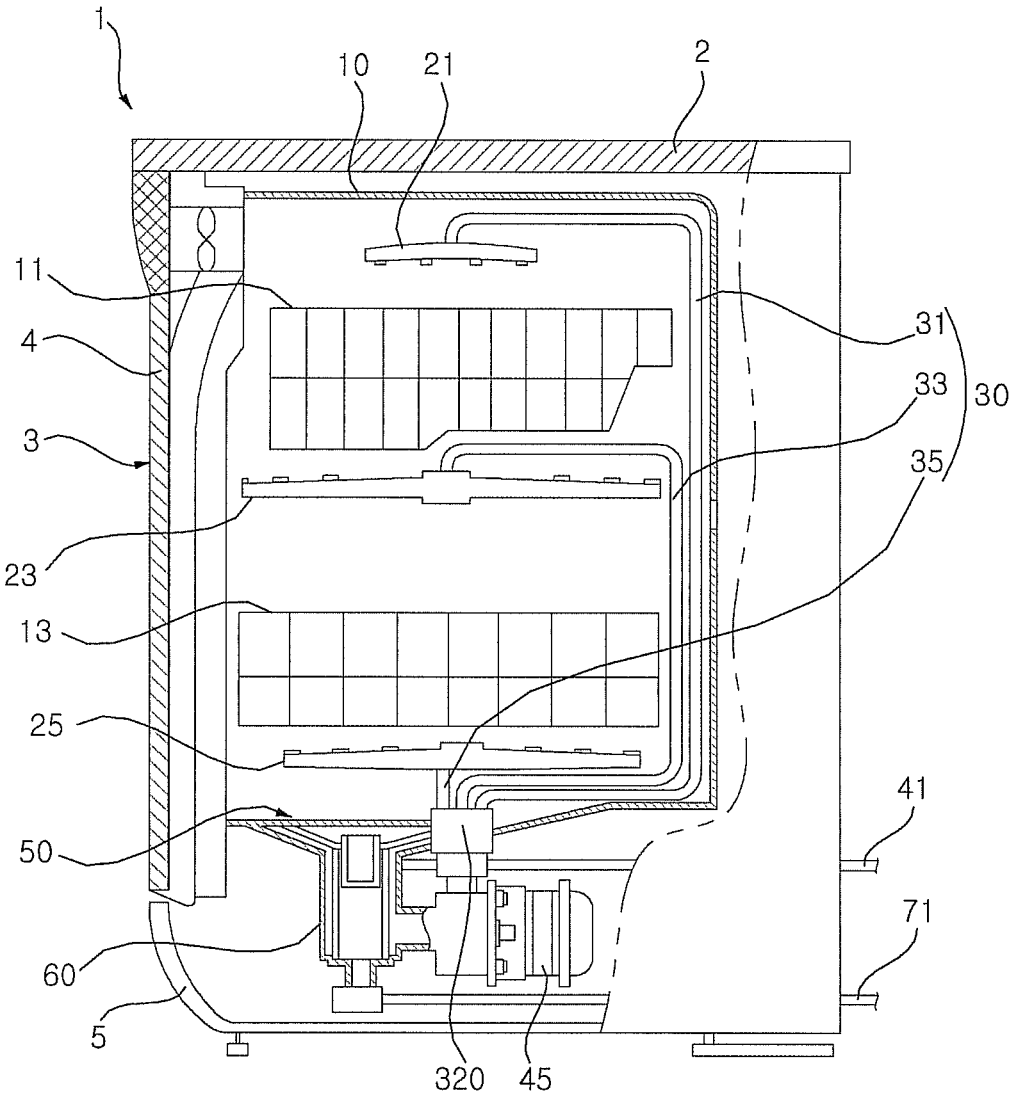
FIG. 2 is a cross-sectional view of a dishwasher according to an embodiment as broadly described herein.
Figure 3:
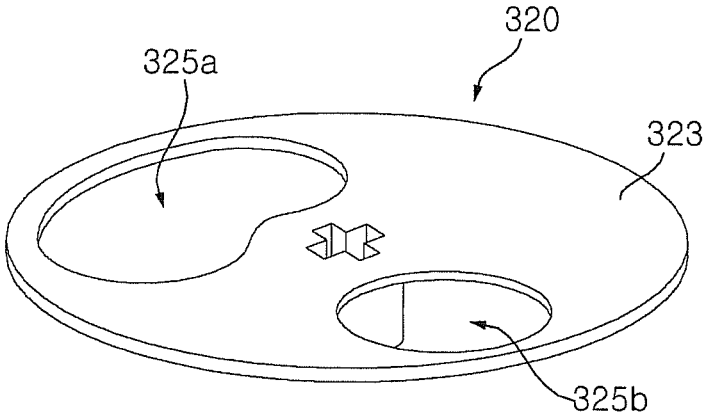
FIG. 3 is a perspective view of a water path switching device and a rotating plate, according to an embodiment as broadly described herein.
Figure 4:
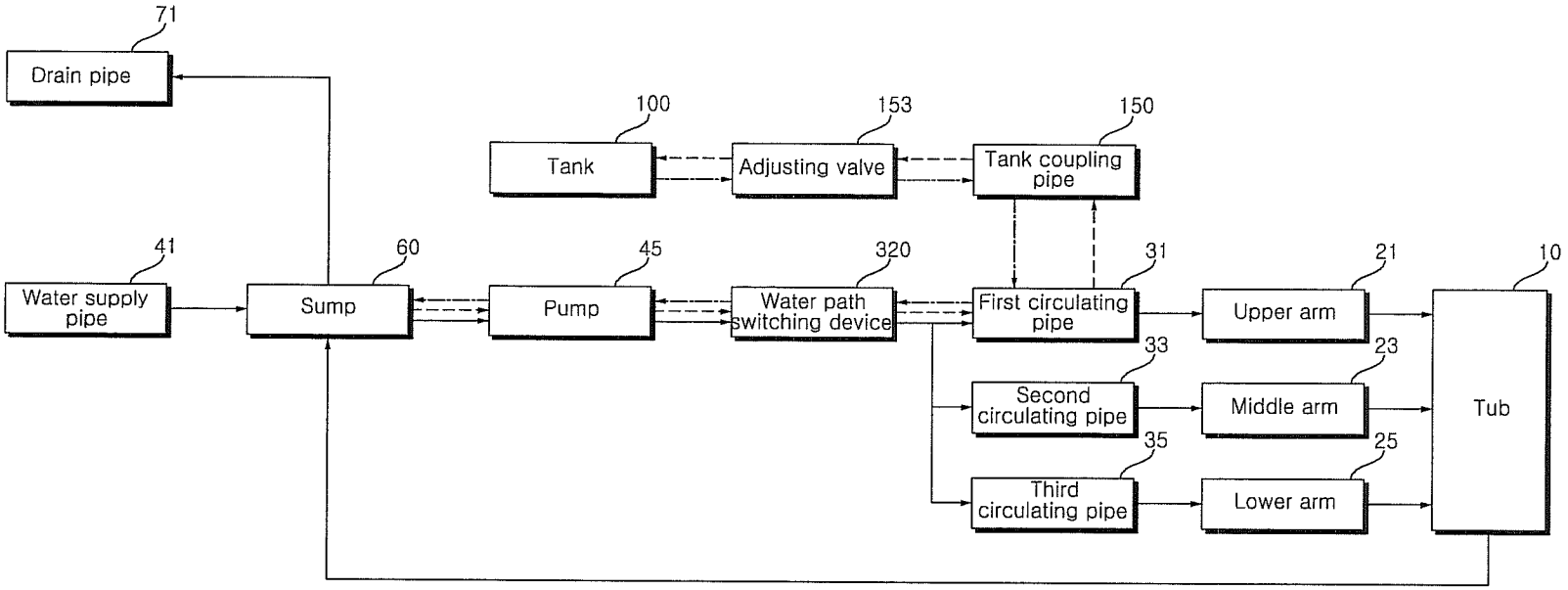
FIG. 4 is a block diagram of a path of washing water of a dishwasher, according to an embodiment as broadly described herein, in which solid lines indicate a path of washing water when a regular washing and rinsing cycle is performed, dotted lines indicate a path along which washing water is stored in the tank, and dash-dotted lines indicate a path along which washing water is discharged from the tank for recycling.
Figure 5:
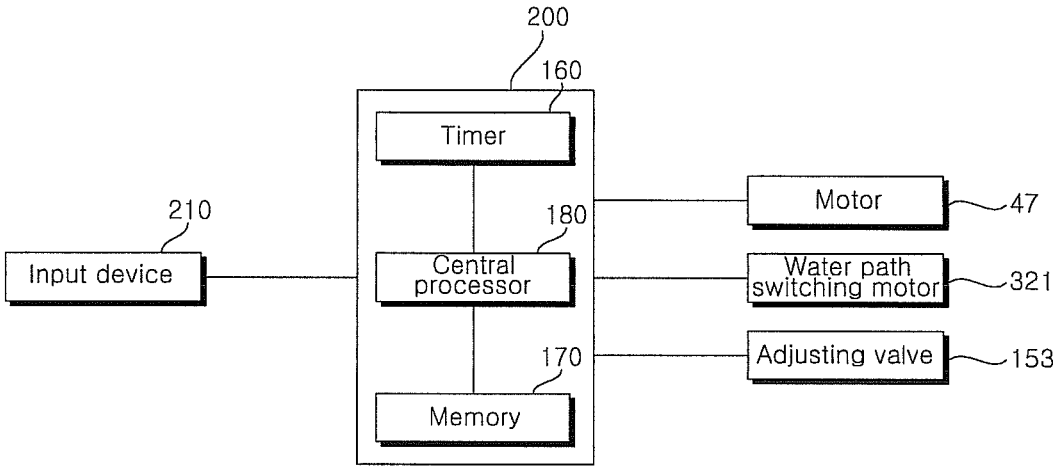
FIG. 5 is a block diagram of a controller of a dishwasher, according to an embodiment as broadly described herein.

Advantages and features may be apparent from the exemplary embodiments described below in detail in connection with the accompanying drawings. However, embodiments are not limited to the disclosed embodiments, and may be embodied in various forms. The exemplary embodiments are provided herein merely to thoroughly disclose the various features and to enable one of ordinary skill in the art. Wherever possible, the same reference denotations refer to the same components throughout the specification.

Referring to FIGS. 1 to 5, a dishwasher 1 according to an embodiment as broadly described herein may include a tub 10 forming a space for washing dishes, a sump 60 collecting washing water 10, a tank 100 forming a storage space of the tub 10, a motor 47 generating a dynamic force to supply washing water from the sump 60 to the tank 100, a controller 200 intermittently driving the motor 47 to thereby incrementally increase the water level of the tank 100, and circulating pipes 30 connected to the tank 100.

A cabinet 2 forms the outside appearance of the dishwasher 1 and provides a frame for housing the various components. The cabinet 2 has a front opening. The tub 10 is provided inside the cabinet 2 is provided the tub 10 in which washing water flows. The tub 10 has a space in which dishes are washed. A door 3 opens and closes the front surface of the cabinet 2. The door 3 seals the tub 10. The door 3 is rotatably coupled to the front surface of the cabinet 2. Washing water is jet into the tub 10 through a washing arm 20. A rack is provided in the tub 10 to receive dishes. The rack is provided in the tub 10 to move back and forth. A plurality of racks may be provided. The plurality of racks may include an upper rack 11 and a lower rack 13. Washing water jet from the tub 10 is collected in the sump 60. A filter assembly 50 filters waste material from the washing water.

A drain pipe 71 is coupled with the sump 60. The washing water collected in the sump 60 is discharged to the outside through the drain pipe 71. The drain pipe 71 may be coupled with, for example, a sewer. Washing water is collected in the sump 60. Washing water may be gathered into the sump 60 through an external supply pipe. Washing water jet into the tub 10 may be collected in the sump 60. The sump 60 is connected with the circulating pipes 30 so that the collected washing water is supplied to the washing arm 20. The sump 60 is provided below the tub 10. The controller 200 drives the motor 47 to thereby store washing water in the tank 100, and if washing water is collected in the sump 60, re-drives the motor 47. The washing water collected in the sump 60 flows and is stored in the tank 100. The tank 100 discharges the stored washing water back into the sump 60. The tank 100 may be coupled with a tank coupling pipe 150 provided between the tank 100 and the sump 60, and washing water flows through the tank coupling pipe 150. The tank coupling pipe 150 may be coupled with at least one of the circulating pipes 30.

A pump 45 may pressurize the washing water collected in the sump 60 so that the washing water flows through the circulating pipes 30. The motor 47 is provided in the pump 45. The motor 47 rotates to forcedly deliver washing water to the circulating pipes 30. Washing water is sprayed from the washing arm 20 into the tub 10 to wash dishes and is collected in the sump 60. The circulating pipes 30 are coupled with the pump 45. In certain embodiments, a plurality of washing arms 20 may be provided at different heights.

The plurality of washing arms 20 may include an upper arm 21 located at a highest position, a lower arm 25 located at a lowest position, and a middle arm 23 located between the upper arm 21 and the lower arm 25. The circulating pipes 30 may include a first circulating pipe 31, a second circulating pipe 33, and a third circulating pipe 35. The upper arm 21 receives washing water from the pump 45 through the first circulating pipe 31. The middle arm 23 receives washing water from the pump 45 through the second circulating pipe 33. The lower arm 25 receives washing water through the third circulating pipe 35. The washing water discharged from the pump 45 may be directed to at least one of the plurality of circulating pipes 30 by a water path switching device 320. The tank coupling pipe 150 may be coupled with the first circulating pipe 31. Washing water flowing through the first circulating pipe 31 is sprayed into the tub 10 through the upper arm 21 or may be stored in the tank 100 through the tank coupling pipe 150.

The water path switching device 320 includes a water path switching motor 321 for generating a rotation force and a rotation plate 323 rotated by the water path switching motor 321 to adjust the flow of washing water. The rotation plate 323 selectively opens and closes a plurality of connecting mechanisms formed where the plurality of washing arms 20 are split. The rotation plate 323 includes a plurality of switching holes, including a first switching hole 325*a* formed as an elongated opening extending along the circumferential direction of the plate 323 and a second substantially circular switching hole 325*b*. The rotation plate 323 is incrementally rotated by the water path switching motor 321. When the rotation plate 323 is rotated by the water path switching motor 321, the plurality of switching holes 325*a* and 325*b* of the rotation plate 323 are positioned to correspond to at least one of the plurality of connecting mechanisms, so that the washing water flowing from the pump 45 is directed to at least one of the plurality of circulating pipes 30.

The water path switching motor 321 generates a rotation force to incrementally rotate the rotation plate 323. The water path switching motor 321 may be a step motor that shifts at a predetermined angle whenever the magnet excitation condition is changed by an input pulse signal, and maintains a predetermined position when there are no changes in the excitation condition. The controller 200 controls the water path switching motor 321. The controller 200 drives the water path switching motor 321 to adjust the position of the rotation plate 323.

The controller 200 controls the water path switching motor 321 so that washing water discharged from the pump 45 may flow to perform one or more cycles, including, for example, a washing cycle, a rinsing cycle, a drying cycle, and a storing cycle.

The controller 200 may be connected with the motor 47, an adjusting valve 153, the water path switching motor 321, and an input device 210 which receives a user's requirement or selection. The controller 200 may include a central processor 180 and a memory 170. The memory 170 stores a program and data relating to various cycles. The memory 170 may store motor driving times relating to a method of storing washing water. The central processor 180 performs various cycles by the program and data relating to the memory 170.

The controller 200 may further include a timer 160. The timer 160 may measure the time of performing various cycles. For example, the timer 160 measures open/close times of various valves, driving times of various motors, and start and end times of various cycles. The central processor 180 receives information from the timer 160 and starts or stops driving each device at a predetermined time. The input device 210 may include at least one device by which a user may enter information such as a dial, a lever, a button, a switch and the like.

A water supply pipe 41 is connected with a water supply source provided in, for example, a home. Washing water flows in through the water supply pipe 41 and is collected in the sump 60. The pump 45 allows the washing water collected in the sump 60 to flow through the circulating pipes 30. The washing water flowing through the circulating pipes 30 is discharged to the tub 10 through the washing arm 20.

When the controller 200 initially stores washing water, when there is no washing water stored in the tank 100, the controller 200 opens the adjusting valve 153 before driving the motor 47. To store additional washing water when washing water is already stored in the tank 100, the controller 200 opens the adjusting valve 153 a predetermined additional arrival time after the motor 47 is driven.

The tank coupling pipe 150 may be connected with any one of the circulating pipes 30. In certain embodiments, the tank coupling pipe 150 is connected with the first circulating pipe 31. When washing water is stored, the tank coupling pipe 150 is opened and washing water is stored into the tank 100 through the tank coupling pipe 150. When the stored washing water is used, the controller 200 opens the tank coupling pipe 150 so that the washing water is collected into the sump 60 thereby recycling the washing water. When the washing water collected in the sump 60 is discharged to the outside, the washing water is drained to the sewer through the drain pipe 71.

Thus, the adjusting valve 153 controls the opening and closing of the tank coupling pipe 150. The adjusting valve 153 receives a command from the controller 200 and switches on/off the washing water stored in the tank 100. If the adjusting valve 153 is opened, the washing water stored in the tank 100 drains away through the circulating pipes 30. The tank 100 may be mounted on the tank coupling pipe 150 or may be mounted at a portion where the tank coupling pipe 150 and the tank 100 are coupled with each other.

Figure 6:
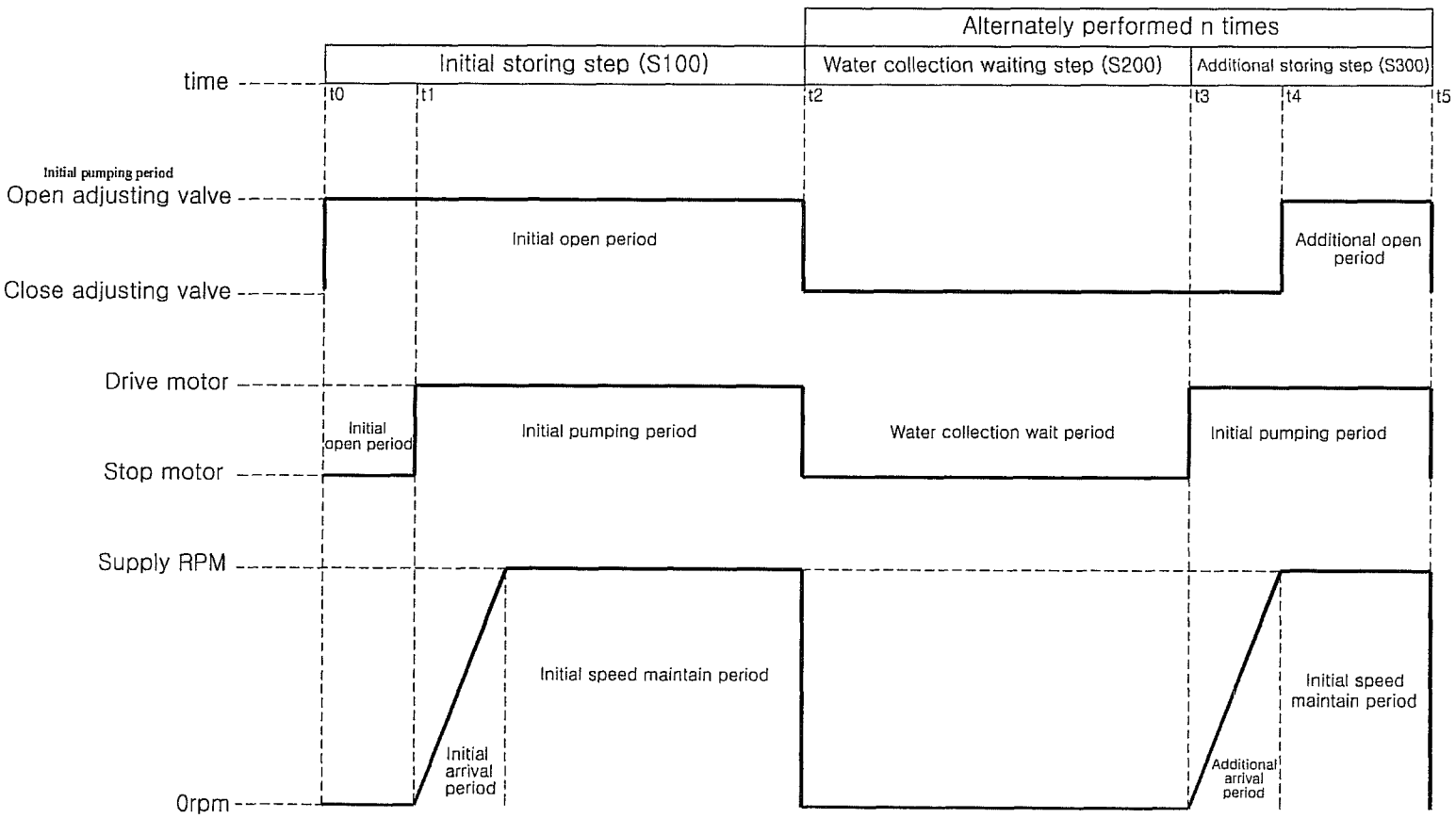
FIG. 6 illustrates operation over time of a dishwasher, according to an embodiment as broadly described herein.

FIG. 6 is a graph of operation of a dishwasher over time, according to an embodiment as broadly described herein.

The controller 200, when washing water is added to the tank 100 with washing water already stored in the tank 100, opens the adjusting valve 153 when the motor 47 reaches a predetermined supply RPM. The adjusting valve 153 may switch on/off a water path formed between the tank 100 and the motor 47. The controller 200 closes the adjusting valve 153 when the motor 47 is stopped.

The tank 100 stores washing water. As used herein, the term "initial state" may refer to a state in which the tank 100 is empty without washing water stored therein. If the motor 47 is driven and the adjusting valve 153 is opened, washing water flows through the circulating pipes 30 into the tank 100. The controller 200 may also drive the motor 47 at the initial state and then open the adjusting valve 153. In certain embodiments, the adjusting valve 153 is opened and the motor 47 is driven. Upon driving the motor 47 after driving the adjusting valve 153 at the initial state, noise that may be generated when washing water collides with the adjusting valve 153 may be reduced.

The controller 200 drives the motor 47 for an initial pumping time when the tank 100 stays empty without washing water and drives the motor 47 for an additional pumping time when washing water is stored in the tank 100. The initial pumping time is determined to be different from the additional pumping time. The controller 200 drives the motor 47 multiple times, for a duration as long as the additional pumping time. If the initial pumping time passes, the controller 200 puts a hold on the motor 47 for a predetermined water collection wait time. If the additional pumping time elapses, the controller 200 stops the motor 47 for a predetermined water collection wait time. The initial pumping time is longer than the water collection wait time, and the water collection wait time is longer than the additional pumping time. When the rotation count of the motor 47 reaches a predetermined number for the additional pumping time, the controller 200 opens the adjusting valve 153.

If an initial wait period t0 to t1 passes after the adjusting valve 153 is opened, the controller 200 may instruct the motor 47 to be driven. The initial wait period t0 to t1 is a time period from when the adjusting valve 153 is opened at the initial state to when the motor 47 is driven at the initial state. The initial storing step S100 may include an initial open period t0 to t2. Thus, an initial storing step S100 may include the initial wait period t0 to t1 and an initial pumping period t1 to t2. The time when the adjusting valve 153 is opened at the initial state is the start point of the initial opening step, and the time when the adjusting valve 153 is closed is the end point of the initial opening step.

In certain embodiments, the time required for the initial storing step S100 may be, for example, 45 sec. The initial open period t0 to t2 is the period during which, at the initial state, the water path of the tank coupling pipe 150 connecting the tank 100 with the circulating pipes 30 is opened. The start point of the initial open period t0 to t2 is when the adjusting valve 153 is opened at the initial state where the tank 100 is empty. The end point of the initial open period t0 to t2 may be the same as the time point of a water collection wait period t2 to t3. The end point of the initial open period t0 to t2 may be the same as the end point of the initial pumping period t1 to t2. The end point of the initial open period t0 to t2 may be the same as the end point of an initial speed maintain period. In certain embodiments, the time required for the initial open period t0 to t2 may be, for example, 45 sec. An initial wait period t0 to 1 is the period from when the adjusting valve 153 is opened until the motor 47 is driven. The start point of the initial wait period t0 to 1 may be the same as the start point of the initial open period t0 to t2. The end point of the initial wait period t0 to t1 may be the same as the start point of the initial pumping period t1 to t2. In certain embodiments, the time required for the initial wait period t0 to t1 may be, for example, 5 sec.

The initial pumping period t1 to t2 is the period during which the motor 47 is driven so that washing water flows from the sump to the tank 100. The initial pumping period t1 to t2 is the period during which the motor 47 is driven so that washing water is stored in the tank 100. The start point of the initial pumping period t1 to t2 is the same as the end point of the initial wait period. The initial pumping period t1 to t2 comes after a predetermined time passes from the start point of the initial open period t0 to t2.

The end point of the initial pumping period t1 to t2 may be the same as the start point of the water collection waiting step S200. The end point of the initial pumping period t1 to t2 may be the same as the end point of the initial open period t0 to t2. The end point of the initial pumping period t1 to t2 may be the same as the initial speed maintain period. In certain embodiments, the time required for the initial pumping period t1 to t2 may be, for example, 40 sec.

In certain embodiments, the start point of the initial pumping period t1 to t2 may come five seconds after the adjusting valve 153 is opened, and the end point of the initial pumping period t1 to t2 may come 45 seconds after the adjusting valve 153 is opened. An initial arrival period may be the period during which at the initial state the motor 47 is driven to reach a predetermined supply rpm. The initial speed maintain period is the period during which at the initial state the motor 47 is driven maintaining a predetermined supply rpm. The supply rpm may be a rotation count of the motor 47 driven such that washing water is jet through the washing arm 20 into the tub 10 while washing water is simultaneously stored in the tank 100.

The start point of the initial arrival period may be the same as the start point of the initial pumping period t1 to t2. The end point of the initial arrival period may be the time at which a predetermined supply rpm is reached. In certain embodiments, the time required for the initial arrival period may be 3 sec. The start point of the initial speed maintain period may be the same as the end point of the initial arrival period. The end point of the initial speed maintain period may be the same as the initial pumping period t1 to t2. In certain embodiments, the time required for the initial speed maintain period may be 37 sec.

According to an embodiment, when washing water is added to the tank 100 with washing water already stored in the tank 100, if a predetermined additional arrival period t3 to t4 passes after the motor 47 is driven or the motor 47 reaches a predetermined supply RPM, the controller 200 opens the adjusting valve 153. An additional storing step S300 may include an additional open period t4 to t5. The additional storing step S300 may include an additional pumping period t3 to t5. The additional storing step S300 may include the additional arrival period t3 to t4 and an additional speed maintain period t4 to t5.

In certain embodiments, the time required for the additional storing step S300 may be 7 sec. The additional storing step S300 may be repeatedly performed n times, for example, five times. The additional storing step S300 is conducted alternately with the water collection waiting step S200.

The additional open period t4 to t5 may be the period during which the water path of the tank coupling pipe 150 is opened so that washing water is added to the tank 100. If the initial storing step S100 is terminated, washing water is present in the tank 100. The controller 200 may control the adjusting valve 153 and the motor 47 in a different way from the initial step so that washing water is added to the tank 100 while the volume of the washing water already stored is maintained.

The start point of the additional open period t4 to t5 may be the same as the end point of the additional arrival period t3 to t4. The start point of the additional open period t4 to t5 follows the start point of the additional pumping period t3 to t5. Opening the adjusting valve 153 is carried out during the additional pumping period t3 to t5. The start point of the additional open period t4 to t5 may fall when the motor 47 is driven such that although the adjusting valve 153 is opened, the washing water stored in the tank 100 is prevented from flowing through the circulating pipes 30. In certain embodiments, the start point of the additional open period t4 to t5 may be when the motor 47 reaches 1200 rpm, and/or when three seconds pass after the additional pumping period t3 to t5 elapses, and/or when the additional arrival period t3 to t4 elapses. The end point of the additional open period t4 to t5 may be the same as the end point of the additional pumping period t3 to t5 and/or the end point of the additional speed maintain period t4 to t5.

Since the additional storing step S300 is repeated multiple times, the additional open period t4 to t5 may also be repeated multiple times. In certain embodiments, the additional open period t4 to t5 may be repeated five times, and the required time for the additional open period t4 to t5 may be 4 sec. The additional open period t4 to t5 may alternate with the water collection wait period t2 to t3.

The additional pumping period t3 to t5 may be the period during which the motor 47 is driven to add washing water. During the additional pumping period t3 to t5 the motor 47 may be momentarily/intermittently driven to incrementally increase the washing water stored in the tank 100. The start point of the additional pumping period t3 to t5 may be the same as the end point of the water collection wait period t2 to 3. The end point of the additional pumping period t3 to t5 may be the same as the end point of the additional open period t4 to t5.

In certain embodiments, the time required for the additional pumping period t3 to t5 may be 7 sec. Further, the additional pumping period t3 to t5 may be repeatedly performed n times, and the additional pumping period t3 to t5 may be performed alternately with the water collection wait period t2 to t3. In certain embodiments, the start point of the additional pumping period t3 to t5 may come again eight seconds after the motor 47 is stopped. The start point of the additional arrival period t3 to t4 may be the same as the end point of the water collection wait period t2 to 3. The end point of the additional arrival period t3 to t4 may be the same as the start point of the additional open period t4 to t5.

In certain embodiments, the time required for the additional arrival period t3 to t4 may be 3 sec. Also, the additional arrival period t3 to t4 may arrive repeatedly n times, and the additional arrival period t3 to t4 and the additional speed maintain period t4 to t5 may arrive alternately with the water collection wait period t2 to t3.

The additional arrival period t3 to t4 may be the period during which the motor 47 is driven to reach a predetermined supply RPM. The additional speed maintain period t4 to t5 may be the period during which the motor 47 is driven while maintaining a predetermined supply RPM. The supply RPM may be a rotation count of the motor 47 that is driven such that the washing water stored in the tank 100 is not discharged to the circulating pipes 30. The supply RPM may be a rotation count of the motor 47 such that washing water is sprayed through the washing arm 20 into the tub 10 while washing water is simultaneously stored in the tank 100.

The start point of the additional speed maintain period t4 to t5 may be the same as the additional open period t4 to t5. The end point of the additional speed maintain period t4 to t5 may be the same as the additional pumping period t3 to t5 and/or additional open period t4 to t5. In certain embodiments, the time required for the additional speed maintain period t4 to t5 may be 4 sec. Further, the additional speed maintain period t4 to t5 may arrive repeatedly n times, and the additional arrival period t3 to t4 and the additional speed maintain period t4 to t5 arrive alternately with the water collection wait period t2 to t3.

In certain embodiments, the controller 200, when stopping the motor 47, may close the adjusting valve 153. The controller 200, after closing the adjusting valve 153, may stop the motor 47 as well. The controller 200 may instruct the adjusting valve 153 and the motor 47 to be stopped at the same time. In certain embodiments, the controller 200 may close the adjusting valve 153 before the washing water stored in the tank 100 is drained. Closing the adjusting valve 153 and stopping the motor 47 may be performed when the initial storing step S100 is terminated. Closing the adjusting valve 153 and stopping the motor 47 may be carried out simultaneously with start of the water collection waiting step S200.

When storing washing water at the initial state, where no washing water is stored in the tank 100, the controller 200 may drive the motor 47 during a predetermined initial pumping period t1 to t2. When adding washing water to the tank 100, the tank 100 already having washing water stored therein, the controller 200 may drive the motor 47 during a predetermined additional pumping period t3 to t5. The initial pumping period t1 to t2 may be the period during which the motor 47 is driven so that washing water is stored in the tank 100.

The start point of the initial pumping period t1 to t2 may be the same as the end point of the initial wait period t0 to 1. The initial pumping period t1 to t2 may begin a predetermined time after the start point of the initial open period t0 to t2. The end point of the initial pumping period t1 to t2 may be the same as the start point of the water collection waiting step S200. The end point of the initial pumping period t1 to t2 may be the same as the end point of the initial open period t0 to t2. The end point of the initial pumping period t1 to t2 may be the same as the initial speed maintain period. In certain embodiments, the time required for the initial pumping period t1 to t2 may be 40 sec. In certain embodiments, the start point of the initial pumping period t1 to t2 may be, for example, five seconds after the adjusting valve 153 is opened, and the end point of the initial pumping period t1 to t2 may be, for example, 45 seconds after the adjusting valve 153 is opened.

The additional pumping period t3 to t5 may be the period during which the motor 47 is driven to add washing water to the tank 100. The additional pumping period t3 to t5 may be the period during which the motor 47 is momentarily/intermittently driven to incrementally increase the washing water stored in the tank 100. The start point of the additional pumping period t3 to t5 may be the same as the end point of the water collection wait period t2 to t3. The end point of the additional pumping period t3 to t5 may be the same as the end point of the additional open period t4 to t5.

In certain embodiments, when the initial pumping period t1 to t2 has elapsed, the controller 200 may drive the motor 47 so that the additional pumping period t3 to t5 is repeated multiple times. The additional pumping period t3 to t5 may be repeatedly performed n times and the additional pumping period t3 to t5 may be alternately performed with the water collection wait period t2 to t3.

According to an embodiment as broadly described herein, the additional pumping period t3 to t5 may be, for example, seven seconds. Further, the start point of the additional pumping period t3 to t5 may come again eight seconds after the motor 47 is stopped. In certain embodiments, the initial pumping period t1 to t2 may be longer than the additional pumping period t3 to t5. The time for the additional pumping period t3 to t5 and the initial pumping period t1 to t2 may vary depending on the size of the tank 100 and output of the motor 47. In certain embodiments, the initial pumping period t1 to t2 may be 40 sec, and the additional pumping period t3 to t5 may be 7 sec.

According to an embodiment as broadly described herein, the controller 200 stops driving the motor 47 during a predetermined water collection wait period t2 to t3 so that the washing water directed to the tub 10 is collected in the sump 60 while the motor 47 is driven. The water collection waiting step S200 may include the water collection wait period t2 to t3.

In certain embodiments, the time for the water collection waiting step S200 may be 8 sec. The water collection waiting step S200 may be performed repeatedly n times, for example, five times. The water collection waiting step S200 may be performed alternately with the additional storing step S300. The water collection wait period t2 to t3 may be a wait period during which the washing water present in the tub 10 or the washing arm 20 is collected in the sump. The water collection wait period t2 to t3 may be a wait period during which the washing water previously provided to the tub 10 during the initial storing step S100 or additional storing step S300 is collected in the sump. The motor 47 may be stopped and not driven during the water collection wait period t2 to t3.

Further, the adjusting valve 153 may close the water path of the tank coupling pipe 150 to prevent the stored washing water from being discharged during the water collection wait period t2 to t3. The start point of the water collection wait period t2 to t3 may be the same as the end point of the initial open period t0 to t2 and/or end point of the initial pumping period t1 to t2 and/or the end point of the initial speed maintain period. The end point of the water collection wait period t2 to t3 may be the same as the start point of the additional pumping period t3 to t5.

According to an embodiment as broadly described herein, when the water collection wait period t2 to t3 is terminated, the controller 200 may drive the motor 47 so that the water collection wait period t2 to t3 is repeated multiple times. In certain embodiments, time for the water collection wait period t2 to t3 may be 8 sec. The water collection wait period t2 to t3 may be conducted repeatedly n times. The water collection wait period t2 to t3 may be performed alternately with the additional pumping period t3 to t5. In certain embodiments, the water collection wait period t2 to t3 may be conducted repeatedly five times, and the start point of the water collection wait period t2 to t3 may come seven or 40 seconds after the motor 47 starts to be driven.

Figure 7:
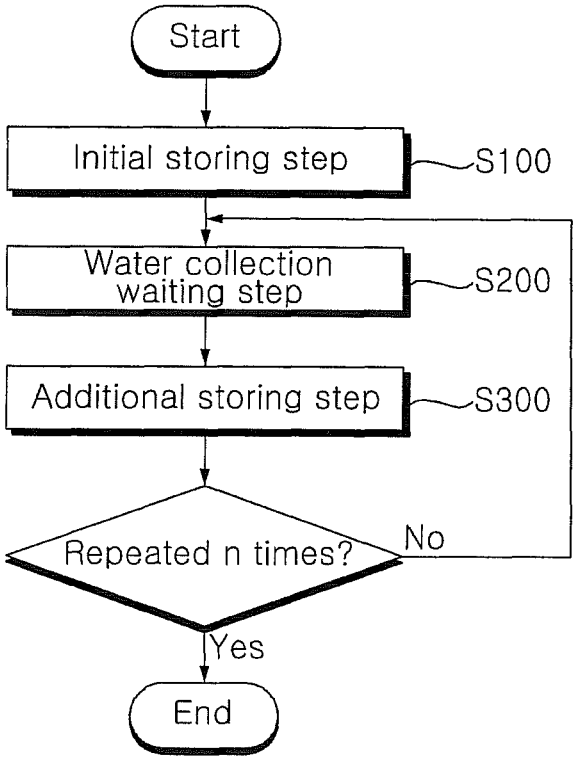
FIG. 7 is a flowchart of a method of controlling a dishwasher, according to an embodiment as broadly described herein.
Figure 8:
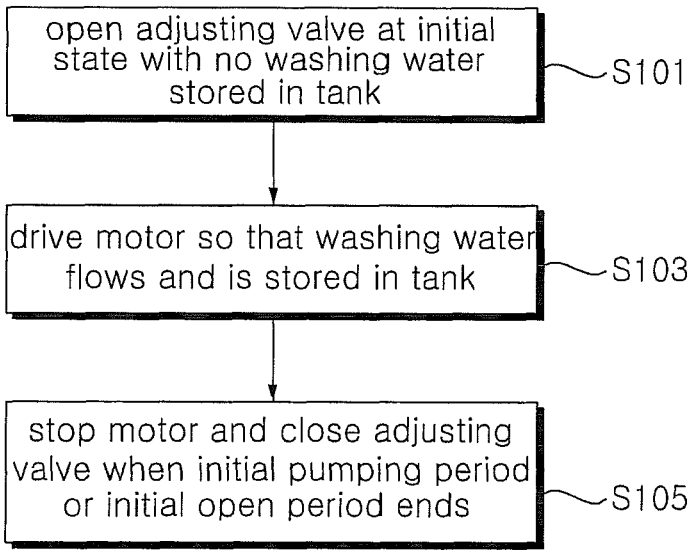
FIG. 8 is a flowchart of the initial storing step of the method shown in FIG. 7, according to an embodiment as broadly described herein.
Figure 9:
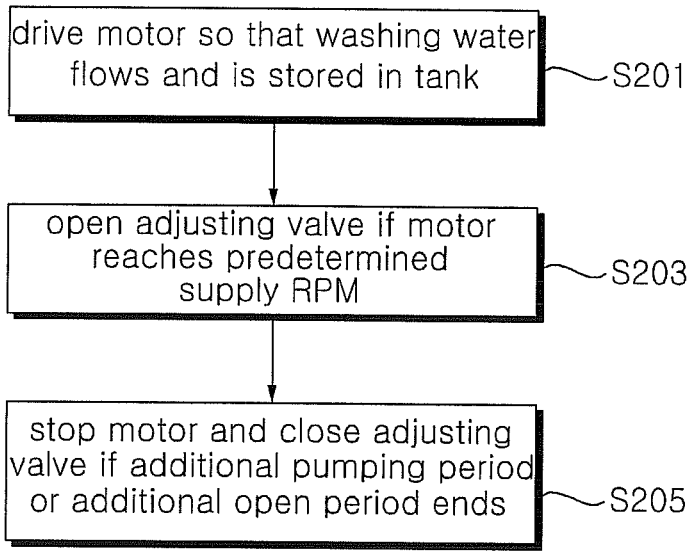
FIG. 9 is a flowchart of the additional storing step of the method shown in FIG. 7, according to an embodiment as broadly described herein.

FIG. 7 is a flowchart of a method of controlling a dishwasher according to an embodiment as broadly described herein. FIG. 8 is a flowchart of the initial storing step S100 of the method shown in FIG. 7. FIG. 9 is a flowchart of the additional storing step S300 of the method shown in FIG. 7.

Referring to FIGS. 7 to 9, a method of controlling a dishwasher 1, as embodied and broadly described herein, may include an initial storing step S100 including driving the motor 47 to supply washing water from the sump 60 to the tank 100, a water collection waiting step S200 including stopping the motor 47 during a predetermined water collection wait period, and an additional storing step S300 including driving the motor 47 to supply the washing water collected in the sump 60 during the water collection waiting step S200 to the tank 100. In the initial storing step S100, the motor 47 may be driven so that washing water flows to the tank 100 connected with the circulating pipes 30, with the adjusting valve 153 open to allow the washing water to flow between the circulating pipes 30 and the tank 100. In the water collection waiting step S200, the motor 47 is stopped during a predetermined water collection wait period t2 to t3 so that the washing water supplied to the tub 10 is collected in the sump while the motor 47 is driven and the adjusting valve 153 is closed. In the an additional storing step S300, the motor 47 is driven and the adjusting valve 153 is open so that the washing water collected in the sump flows to the tank 100 for storage, providing additional water to the tank 100, when the water collection waiting step S200 is completed.

In the additional storing step S300, after the motor 47 is driven, the water path connecting the sump 60 with the tank 100 is opened. In the additional storing step S300, when the motor 47 reaches a predetermined supply RPM, the adjusting valve 153 is opened. In the water collection waiting step S200, the motor 47 is stopped while the adjusting valve 153 is closed. The water collection waiting step S200 and the additional storing step S300 may be repeated multiple times after the initial storing step S100 is ended. A duration of the initial storing step S100 is greater than a duration of the water collection waiting step S200, and the duration of the water collection waiting step S200 is greater than a duration of the additional storing step S300.

The initial storing step S100 may include an initial open period t0 to t2. The initial storing step S100 may include an initial wait period t0 to 1 and an initial pumping period t1 to t2. In certain embodiments, the time for the initial storing step S100 may be 45 sec. The initial open period t0 to t2 may be the period during which the water path of the tank coupling pipe 150 connecting the tank 100 with the circulating pipes 30 is opened at an initial state. The water collection waiting step S200 may include a water collection wait period t2 to t3. In certain embodiments, the time for the water collection waiting step S200 may be 8 sec. The water collection waiting step S200 may be repeatedly performed n times, for example, five times. The water collection waiting step S200 may be carried out alternately with the additional storing step S300.

The water collection wait period t2 to t3 may be a wait period during which the washing water present in the tub 10 or washing arm 20 is collected in the sump. In certain embodiments, the motor 47 may be stopped and not driven during the water collection wait period t2 to t3. Further, the adjusting valve 153 may close the water path of the tank coupling pipe 150 so that the washing water stored during the water collection wait period t2 to t3 is not discharged.

The start point of the water collection wait period t2 to t3 may be the same as the end point of the initial open period t0 to t2 and/or end point of the initial pumping period t1 to t2 and/or the end point of the initial speed maintain period. The end point of the water collection wait period t2 to t3 may be the same as the start point of the additional pumping period t3 to t5. The additional storing step S300 may include an additional open period t4 to t5. The additional storing step S300 may include an additional pumping period t3 to t5. The additional storing step S300 may include an additional arrival period t3 to t4 and an additional speed maintain period t4 to t5.

The additional open period t4 to t5 may be the period during which the water path of the tank coupling pipe 150 is opened so that washing water is added to the tank 100. If the initial storing step S100 is terminated, washing water may remain in the tank 100. The controller 200 may control the motor 47 and the adjusting valve 153 in a different way from the initial step so that washing water is added while the previously stored washing water maintains its volume.

According to an embodiment as broadly described herein, the water collection waiting step S200 and the additional storing step S300 may be repeated multiple times after the initial storing step S100 has ended. The additional storing step S300 may be repeatedly performed n times. In certain embodiments, the time for the additional storing step S300 may be 7 sec, and the additional storing step S300 may be repeatedly performed five times. The additional storing step S300 may be performed alternately with the water collection waiting step S200. The additional storing step S300 may last for a total of 35 sec.

In the initial storing step S100, a predetermined time to open the adjusting valve 153 may come earlier than a predetermined time for driving the motor 47 to drive the pump 45.

The start point of the initial open period t0 to t2 may be when the adjusting valve 153 is opened at an initial state where the tank 100 is empty. The time of opening the adjusting valve 153 at the initial state may be the start point of the initial opening step, and the time of closing the adjusting valve 153 may be the end point of the initial opening step. The end point of the initial open period t0 to t2 may be the same as the start point of the water collection wait period t2 to t3. The end point of the initial open period t0 to t2 may be the same as the end point of the initial pumping period t1 to t2. The end point of the initial open period t0 to t2 may be the same as the end point of the initial speed maintain period. In certain embodiments, the time for the initial open period t0 to t2 may be 45 sec.

The initial wait period t0 to 1 may be the period that elapses until the motor 47 is driven after the adjusting valve 153 is opened. The start point of the initial wait period t0 to 1 may be the same as the start point of the initial open period t0 to t2. The end point of the initial wait period t0 to 1 may be the same as the start point of the initial pumping period t1 to t2. In certain embodiments, the time for the initial wait period t0 tot may be 5 sec.

The initial pumping period t1 to t2 may be the period during which the motor 47 is driven so that washing water flows from the sump to the tank 100 and stored in the tank 100. The start point of the initial pumping period t1 to t2 may be the same as the end point of the initial wait period t0 to 1. The initial pumping period t1 to t2 may come a predetermined time after the start point of the initial open period t0 to t2. The end point of the initial pumping period t1 to t2 may be the same as the start point of the water collection waiting step S200. The end point of the initial pumping period t1 to t2 may be the same as the end point of the initial open period t0 to t2. The end point of the initial pumping period t1 to t2 may be the same as the initial speed maintain period. In certain embodiments, the time for the initial pumping period t1 to t2 may be 40 sec.

In an embodiment as broadly described herein, the start point of the initial pumping period t1 to t2 may come five seconds after the adjusting valve 153 is opened, and the end point of the initial pumping period t1 to t2 may come 45 seconds after the adjusting valve 153 is opened.

The initial arrival period may be the period during which the motor 47 is driven to reach a predetermined supply RPM and may maintain the predetermined supply RPM. The supply RPM may be a rotation count of the motor 47 such that washing water is supplied to the tub 10 via the washing arm 20 while washing water is simultaneously stored in the tank 100.

The start point of the initial arrival period may be the same as the start point of the initial pumping period t1 to t2. The end point of the initial arrival period may be when a predetermined supply RPM is reached. In certain embodiments, the time for the initial arrival period may be 3 sec. The start point of the initial speed maintain period may be the same as the end point of the initial arrival period. The end point of the initial speed maintain period may be the same as the initial pumping period t1 to t2. In certain embodiments, the time for the initial speed maintain period may be 37 sec. The sum of the initial arrival period and the initial speed maintain period may be the same as the initial pumping period t1 to t2.

According to an embodiment as broadly described herein, in the additional storing step S300, a predetermined time of driving the motor 47 to drive the pump 45 may arrive earlier than a predetermined time to open the adjusting valve 153. The start point of the additional open period t4 to t5 may be the time of opening the adjusting valve 153, and the end point of the additional open period t4 to t5 may be the time of closing the adjusting valve 153.

The start point of the additional open period t4 to t5 may be the same as the end point of the additional arrival period t3 to t4. The start point of the additional open period t4 to t5 may be later than the start point of the additional pumping period t3 to t5. Opening the adjusting valve 153 may be conducted during the additional pumping period t3 to t5. In certain embodiments, the start point of the additional open period t4 to t5 may arrive while the motor 47 is driven such that the washing water stored in the tank 100 does not flow to the circulating pipes 30 even when the adjusting valve 153 is opened. In certain embodiments, the start point of the additional open period t4 to t5 may be when the motor 47 reaches 1200 rpm and/or when three seconds pass after the additional pumping period t3 to t5 has elapsed, and/or when the additional arrival period t3 to t4 has elapsed.

The end point of the additional open period t4 to t5 may be the same as the end point of the additional pumping period t3 to t5 and/or the end point of the additional speed maintain period t4 to t5. The additional storing step S300 may be repeated multiple times, and thus, the additional open period t4 to t5 may also be repeated multiple times. In certain embodiments, the additional open period t4 to t5 may be repeated five times, and the time for the additional open period t4 to t5 may be 4 sec. The additional open period t4 to t5 may alternate with the water collection wait period t2 to t3.

The additional pumping period t3 to t5 may be the period during which the motor 47 is driven so that washing water is added to the tank 100. During the additional pumping period t3 to t5 the motor 47 may be momentarily/intermittently driven so that the washing water stored in the tank 100 is incrementally increased. The start point of the additional pumping period t3 to t5 may be the same as the end point of the water collection wait period t2 to t3. The end point of the additional pumping period t3 to t5 may be the same as the end point of the additional open period t4 to t5. In certain embodiments, the time for the additional pumping period t3 to t5 may be 7 sec. Further, the additional pumping period t3 to t5 may be performed repeatedly n times, and the additional pumping period t3 to t5 may alternate with the water collection wait period t2 to t3. In certain embodiments, the start point of the additional pumping period t3 to t5 may come again 8 seconds after the motor 47 is stopped.

The start point of the additional arrival period t3 to t4 may be the same as the end point of the water collection wait period t2 to t3. The end point of the additional arrival period t3 to t4 may be the same as the start point of the additional open period t4 to t5. In certain embodiments, the time for the additional arrival period t3 to t4 may be 3 sec. Further, the additional arrival period t3 to t4 may come repeatedly n times, and the additional arrival period t3 to t4 and the additional speed maintain period t4 to t5 may alternate with the water collection wait period t2 to t3.

The additional arrival period t3 to t4 may be the period during which the motor 47 is driven to reach a predetermined supply RPM and to maintain the predetermined supply RPM. The supply RPM may be a rotation count of the motor 47 such that the washing water stored in the tank 100 is not discharged to the circulating pipes 30.

The supply RPM may be a rotation count of the motor 47 such that washing water is supplied to the tub 10 through the washing arm 20 while washing water is simultaneously stored in the tank 100. The start point of the additional speed maintain period t4 to t5 may be the same as the additional open period t4 to t5. The end point of the additional speed maintain period t4 to t5 may be the same as the additional pumping period t3 to t5 and/or the additional open period t4 to t5.

In certain embodiments, the time for the additional speed maintain period t4 to t5 may be 4 sec. Further, the additional speed maintain period t4 to t5 may come repeatedly n times, and the additional arrival period t3 to t4 and the additional speed maintain period t4 to t5 may alternate with the water collection wait period t2 to t3.

A dishwasher 1 as embodied and broadly described herein, configured as above, and a method of controlling the same are described below in view of operation thereof.

The controller 200 may perform the initial storing step S100 to store washing water when a predetermined time arrives, for example, when a rinsing step during which relatively clean washing water is collected in the sump has ended. The controller 200 controls the water path switching motor 321 so that washing water may flow through the first circulating pipe 31. Thereafter, the adjusting valve 153 is opened so that the washing water flowing through the first circulating pipe 31 may flow to the tank 100 via the tank coupling pipe 150.

If the initial wait period t0 to 1 has elapsed, the controller 200 drives the motor 47 during the initial pumping period t1 to t2. A portion of washing water discharged from the pump 45 is stored in the tank 100, and another portion thereof may be supplied to the tub 10 through, for example, the upper arm 21. When the initial pumping period t1 to t2 has elapsed, the controller 200 stops driving the motor 47 and closes the adjusting valve 153 to prevent overflow of the stored washing water. Meanwhile, the washing water supplied to the tub 10 during the initial pumping period t1 to t2 or initial storing step S100 requires time to be collected back into the sump. Accordingly, the controller 200 maintains a paused state of the pump 45 and the closed position of the adjusting valve 153 during the water collection wait period t2 to t3.

If the water collection wait period t2 to t3 and the water collection waiting step S200 are terminated, the controller 200 performs the additional storing step S300. The controller 200 drives the motor 47 during the additional pumping period t3 to t5 so that the washing water collected in the sump 60 may flow to the first circulating pipe 31. If the adjusting valve 153 is opened too early, the stored washing water may flow backward, and if a predetermined supply RPM is reached or a pre-stored additional arrival time has elapsed, the controller 200 opens the adjusting valve 153 accordingly.

If the adjusting valve 153 is opened, the washing water flowing through the first circulating pipe 31 is introduced into the tank 100 so that washing water is added to the tank 100. Washing water may be drained from the upper arm 21 due to the motor 47 that maintains the supply RPM. Accordingly, the controller 200 repeats the water collection waiting step S200 and the additional storing step S300 to additionally store washing water in the tank 100.

In an embodiment as broadly described herein, the initial storing step S100 is repeated, for example, five times, each for, for example, 45 sec, and the additional storing step S300 is repeated, for example, five times, each for, for example, 15 sec. Accordingly, a storing time of about 120 seconds may be provided. By driving the system in this manner, a maximum amount of the washing water left in the tub 10 may be stored in the tank 100, thus maximizing a volume of re-cycled washing water. Further, if the stored washing water is utilized for a next cycle, the stored washing water is close to a room temperature, so power consumed to heat the washing water may be reduced. Further, the storage capacity of washing water may be increased without separate components, e.g., circulating pipes 30.

A time for performing each step above or a time associated with each period may vary depending on, for example, a capacity of the motor 47, a volume of the tank 100, and other such factors. Further, the water collection wait period may be increased according to, for example, the volume of the sump 60 or the tub 10.

A dishwasher and method of controlling the same are provided that may save water necessary for washing dishes.

A dishwasher according to an embodiment as broadly described herein may include a tub forming a space for washing a dish, a sump collecting washing water jet to the tub, a tank forming an outside storage space of the tub, a motor generating a dynamic force to supply the washing water collected in the sump to the tank, and a controller incrementally increasing a water level of the tank by intermittently driving the motor.

The dishwasher may also include a washing arm disposed in the tub and jetting washing water and a circulating pipe supplying washing water discharged by the motor to the washing arm and the tank.

The dishwasher may also include an adjusting valve switching on/off a water path formed between the tank and the motor, wherein the controller opens the adjusting valve before driving the motor in a case where washing water is stored at an initial state where no washing water is stored in the tank.

The dishwasher may also include an adjusting valve switching on/off a water path formed between the tank and the motor, wherein in a case where washing water is added with washing water stored in the tank, the controller opens the adjusting valve when a predetermined additional arrival period passes after the motor is driven.

The dishwasher may also include an adjusting valve switching on/off a water path formed between the tank and the motor, wherein in a case where washing water is additionally stored in the tank with washing water stored in the tank, the controller opens the adjusting valve when the motor reaches a predetermined supply RPM.

The dishwasher may also include an adjusting valve switching on/off a water path formed between the tank and the motor, wherein the controller closes the adjusting valve when stopping the motor.

The controller may drive the motor to store washing water in the tank, and then, if washing water is collected in the sump, may re-drive the motor.

The controller may drive the motor as long as an initial pumping time when no washing water is stored in the tank, and may drive the motor as long as an additional pumping time when washing water is stored in the tank, and wherein the initial pumping time is set to be different from the additional pumping time.

The controller may drive the motor multiple times as long as the additional pumping time.

When the initial pumping time passes, the controller may stop the motor as long as a predetermined water collection wait time.

If the additional pumping time passes, the controller may stop the motor as long as a predetermined water collection wait time.

The initial pumping time may be longer than the water collection wait time, and the water collection wait time may be longer than the additional pumping time.

The dishwasher may also include an adjusting valve switching on/off a water path formed between the tank and the motor, wherein the controller opens the adjusting valve when a rotation count of the motor reaches a predetermined value during the additional pumping time.

According to an embodiment as broadly described herein, a method of controlling a dishwasher, the dishwasher including a tub forming a space for washing a dish, a sump collecting washing water jet to the tub and a tank forming an outside storage space of the tub, may include an initial storing step driving a motor to supply washing water collected in the sump to the tank, a water collection wait step stopping the motor for a predetermined water collection wait period, and an additional storing step driving the motor to supply washing water collected in the sump during the water collection waiting step to the tank.

The additional storing step may include opening an adjusting valve switching on/off a water path connecting the sump with the tank after driving the motor.

The additional storing step may include opening the adjusting valve when the motor reaches a predetermined supply RPM.

The water collection waiting step may include closing the adjusting valve while stopping the motor.

The water collection waiting step and the additional storing step may be repeated multiple times after the initial storing step is ended.

The initial storing step may be performed longer than the water collection waiting step, and the water collection waiting step may be performed longer than the additional storing step.

According to an embodiment as broadly described herein, a method of controlling a dishwasher, the dishwasher including a tub forming a space for washing a dish, a sump collecting washing water jet to the tub, and a tank forming an outside storage space of the tub, may include an initial storing step driving a motor to supply washing water collected in the sump to a washing arm provided in the tub and a circulating pipe connected with the tank, so that washing water flows to the tank via a switching valve switching on/off the circulating pipe, a water collection waiting step stopping the motor until washing water jet from the washing arm is collected in the sump, and a step driving the motor to increase a water level of washing water stored in the tank.

In a dishwasher and a method of controlling the same, as embodied and broadly described herein, washing water which has been already used may be stored, and as necessary, be recycled, thus saving washing water, and washing water may be retained at room temperature, thus saving energy necessary for heating washing water.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a dishwasher, the dishwasher comprising a tub forming a washing space, a sump collecting washing water, and a tank forming a storage space separate from the tub, the method comprising:

performing an initial storing step, comprising:

opening an adjusting valve at a beginning of an initial wait period while a motor is idle, wherein the adjusting valve is provided in a water path connecting the sump with the tank;

in response to determining when a specific predetermined time ends from the beginning of the initial wait period, providing an instruction to drive the motor; and in response to receiving the instruction to drive the motor, driving the motor to supply washing water collected in the sump to the tank;

performing a water collection wait step, comprising stopping the motor for a predetermined water collection wait period; and performing an additional storing step, comprising driving the motor again to supply washing water, collected in the sump during the water collection wait step, to the tank, wherein the additional storing step further comprises:

monitoring when the motor reaches a predetermined supply RPM, in response to the monitoring of the motor reaching the predetermined supply RPM, opening the adjusting valve provided in a water path connecting the sump with the tank after the driving of the motor again.

2. The method of claim 1, wherein the additional storing step further comprises opening the adjusting valve when the motor reaches a predetermined supply RPM.

3. The method of claim 1, wherein the water collection waiting step includes closing the adjusting valve while stopping the motor.

4. The method of claim 1, further comprising repeating the water collection waiting step and the additional storing step multiple times after completing the initial storing step.

5. The method of claim 1, wherein a duration of the initial storing step is greater than a duration of the water collection waiting step, and the duration of the water collection waiting step is greater than a duration of the additional storing step.

6. The method of claim 1, wherein the initial storing step comprises opening the adjusting valve at the initial state where the tank is empty, and driving the motor such that washing water flows from the sump to the tank.

7. A method of a dishwasher, the dishwasher including a tub, a sump that collects washing water, a tank that provides a storage space, and an adjusting valve between the sump and the tank, the method comprising:

performing a storing operation by:

opening the adjusting valve at a beginning of an initial wait period while a motor is idle, determining when a specific predetermined time ends from the beginning of the initial wait period, in response to the determination that the specific predetermined time ends, providing an instruction to drive the motor;

in response to receiving the instruction to drive the motor, driving the motor to supply washing water collected in the sump to the tank;

performing a water collection wait operation by stopping the motor for a predetermined wait period; and performing an additional storing operation by again driving the motor to supply, to the tank, washing water collected in the sump during the water collection wait operation, wherein the additional storing operation includes:

monitoring when the motor reaches a predetermined RPM, determining, based on the monitoring, that the motor reaches the predetermined RPM, and in response to the determination that the motor reaches the predetermined RPM, opening the adjusting valve after again the driving of the motor.

8. The method of claim 7, wherein the additional storing operation includes opening the adjusting valve when the motor reaches the predetermined RPM.

9. The method of claim 7, wherein the water collection wait operation includes closing the adjusting valve while stopping the motor.

10. The method of claim 7, further comprising repeating the water collection wait operation and the additional storing operation multiple times after completing the storing operation.

11. The method of claim 7, wherein a duration of the storing operation is greater than a duration of the water collection wait operation, and the duration of the water collection wait operation is greater than a duration of the additional storing operation.

12. The method of claim 7, wherein the storing operation includes opening the adjusting valve at an initial state where the tank is empty, and driving the motor such that washing water flows from the sump to the tank.

* * * * *